US006978842B2

(12) United States Patent
Read, Jr. et al.

(10) Patent No.: US 6,978,842 B2
(45) Date of Patent: Dec. 27, 2005

(54) VOLUME COMPENSATED SHIFTING TOOL

(75) Inventors: Dennis M. Read, Jr., Manvel, TX (US); Clay W. Milligan, Jr., Missouri City, TX (US)

(73) Assignee: Schlumberger Technology Corporation, SugarLand, TX (US)

( * ) Notice: Subject to any disclaimer, the term of this patent is extended or adjusted under 35 U.S.C. 154(b) by 140 days.

(21) Appl. No.: 10/661,900

(22) Filed: Sep. 12, 2003

(65) Prior Publication Data

US 2004/0094310 A1 May 20, 2004

Related U.S. Application Data

(60) Provisional application No. 60/410,359, filed on Sep. 13, 2002.

(51) Int. Cl.[7] ..... E21B 34/10
(52) U.S. Cl. ..... 166/383; 166/322; 166/332.1
(58) Field of Search ..... 166/381, 383, 166/386, 319, 320, 321, 322, 332.1

(56) References Cited

U.S. PATENT DOCUMENTS

| | | | | | |
|---|---|---|---|---|---|
| 4,361,188 | A | * | 11/1982 | Russell | 166/381 |
| 5,156,210 | A | * | 10/1992 | Roth | 166/319 |
| 5,462,121 | A | | 10/1995 | Schmuck et al. | |
| 6,012,518 | A | | 1/2000 | Pringle et al. | |
| 6,068,015 | A | | 5/2000 | Pringle | |
| 6,290,004 | B1 | | 9/2001 | Evans | |
| 6,308,783 | B2 | | 10/2001 | Pringle et al. | |
| 6,523,613 | B2 | | 2/2003 | Rayssiguier et al. | |

FOREIGN PATENT DOCUMENTS

| | | | | |
|---|---|---|---|---|
| EP | 1018593 | | 7/2000 | |
| GB | 2392937 | * | 3/2004 | E21B 23/00 |

* cited by examiner

*Primary Examiner*—William Neuder
(74) *Attorney, Agent, or Firm*—Trop, Pruner & Hu, P.C.; Kevin McEnaney; Jaime A. Castano

(57) ABSTRACT

The present invention provides for an apparatus and method of use for a hydraulic shifting tool to be used in a sealed volume in a subsurface well completion to actuate a downhole device, without a fluid return to surface or the well annulus.

20 Claims, 10 Drawing Sheets

VOLUME COMPENSATED SHIFTING TOOL

This application claims the benefit of U.S. Provisional Application 60/410,359, filed on Sep. 13, 2002.

BACKGROUND

1. Field of Invention

The present invention pertains to shifting tools used in subsurface well completions, and particularly to hydraulic shifting tools used in closed hydraulic volumes.

2. Related Art

Shifting tools are commonly used in well completions in which actuation of a tool is brought about by relative movement of a tool element. This can be, for example, opening or closing a valve (e.g., sleeve, ball, or flapper), setting a packer, or initiating an explosive train. The earliest shifting tools were simple mechanical devices that engaged a profile in the tool element to be moved, and the tool element was moved as an operator manipulated the shifting tool.

More sophisticated shifting tools use hydraulic pressure to apply a force to a moveable element, such as a piston, to induce motion of the element. Existing hydraulic shifting tools generally require a fluid path to the surface or well annulus to permit movement of relatively incompressible well fluids. If such tools are run into a sealed volume, the tool will be stopped from advancing, and the piston will be prevented from moving, unless the fluid within the volume is routed to the surface or well annulus.

SUMMARY

The present invention provides for an apparatus and method of use for a hydraulic shifting tool to be used in a sealed volume in a subsurface well completion to actuate a downhole device, without a fluid return to surface or the well annulus.

Advantages and other features of the invention will become apparent from the following description, drawings, and claims.

DETAILED DESCRIPTION

Figure 1A:
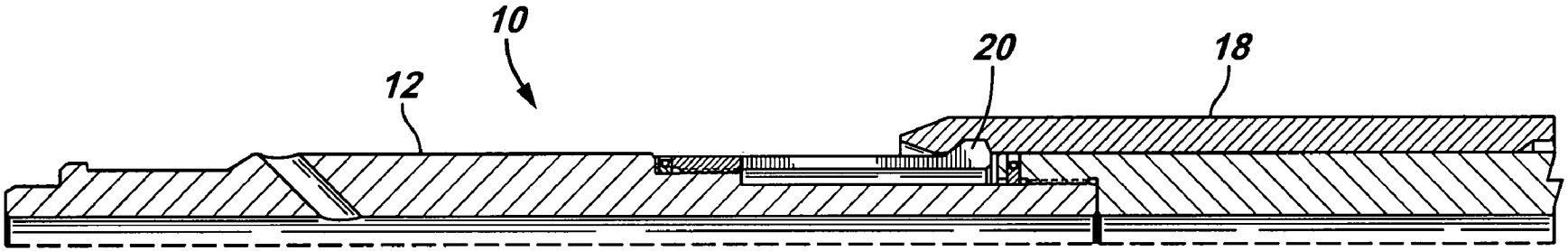
FIGS. 1A–1E are cross-sectional diagrams of a volume compensated shifting tool according to an embodiment of the invention, showing the shifting tool in a run in configuration.
Figure 1B:
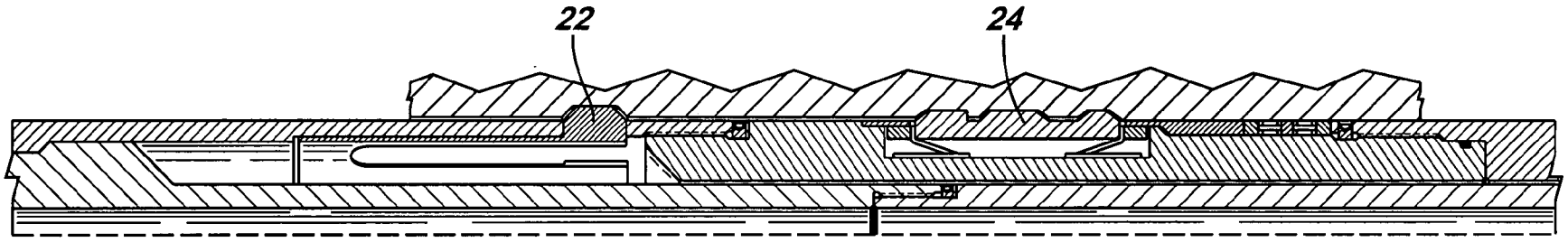
Figure 1C:
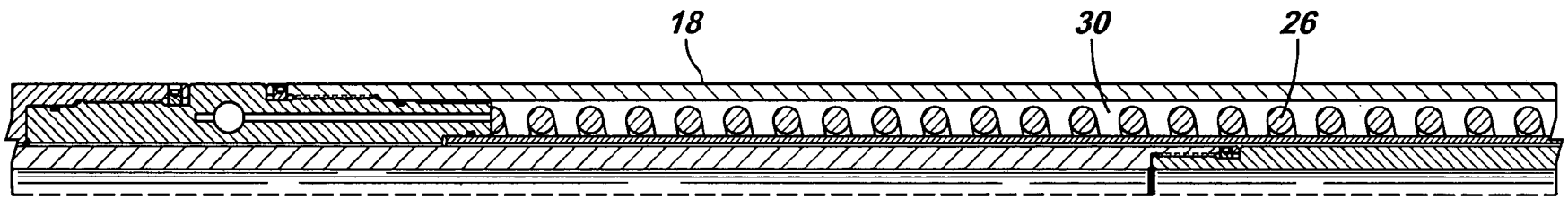
Figure 1D:
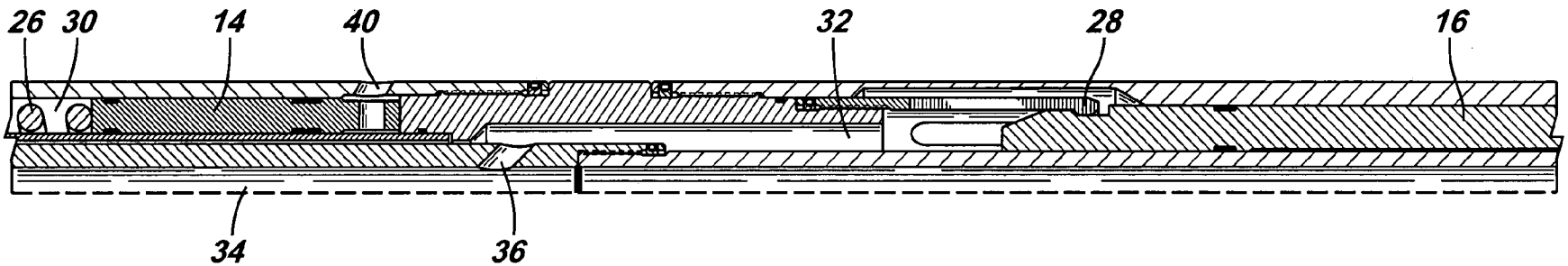
Figure 1E:
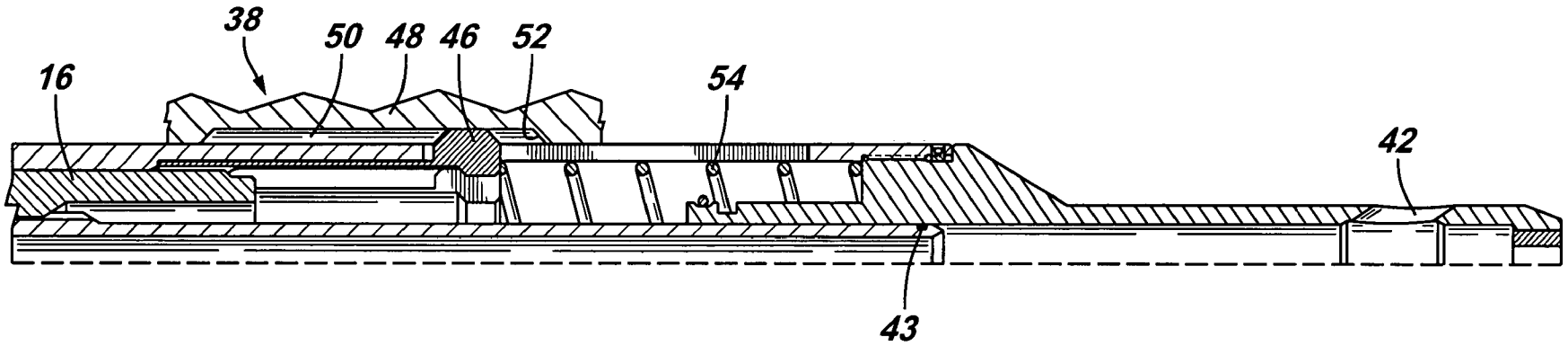

Referring to FIGS. 1A–1E, a volume compensated shifting tool 10 has, in accordance with an embodiment of the invention, an inner sleeve 12, a compensating piston 14, an actuator piston 16, and a housing 18.

Inner sleeve 12 is disposed within housing 18 and releasably engages housing 18 with an upper collet 20. Housing 18 carries a locking dog 22, a locator dog 24, an upper spring

26, a lower collet 28, compensating piston 14, and actuator piston 16. Compensating piston 14 and actuator piston 16 are disposed in chambers 30 and 32, respectively, within housing 18. Chamber 32 is in fluid communication with an interior 34 of a tubing (not shown) via a lower port 36, and chamber 30 is in fluid communication with the interior of a tool body 38 (only a representative portion of which is shown) via an upper port 40. Housing 18 also has a balance port 42 on the lower end of housing 18 to allow fluid communication between the interior of tool body 38 and tubing interior 34. Inner sleeve 12 carries a seal 43 on its lower end that seals against the inner wall of housing 18.

Actuator piston 16 releasably engages housing 18 with lower collet 28. A shifting element 46 is slidably mounted to housing 18 and moves within a slot therein in response to the movement of actuator piston 16. Shifting element 46 engages a moveable assembly 48 that is part of tool body 38. Moveable assembly 48 has a recess 50 terminated on its lower end by a shoulder 52. Shifting element 46 moves within recess 50, causing moveable assembly 48 to move down when shifting element 46 bears on shoulder 52. A lower spring 54 is carried in the lower end of chamber 32 and bears against shifting element 46.

In operation, shifting tool 10 is initially run in on wireline or other common deployment system. Shifting tool 10 is held in its running-in position by collet 20. Shifting tool 10 is run in until locator dog 24 catches on a matching profile in a nipple or portion of tool body 38 to properly position shifting tool 10.

Figure 2A:
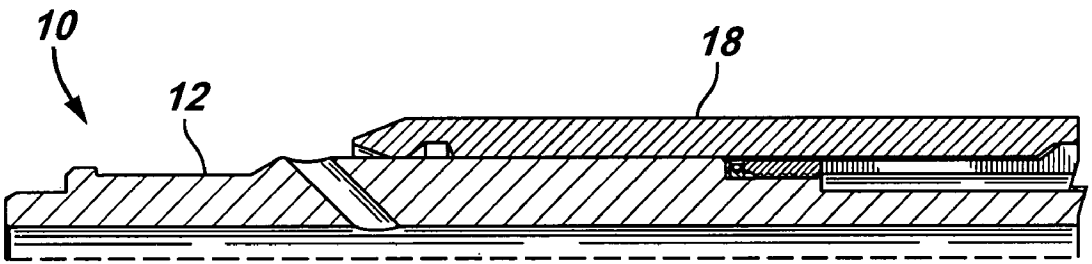
FIGS. 2A–2E are cross-sectional diagrams of the shifting tool of FIGS. 1A–1E, showing the shifting tool in a locked in configuration.
Figure 2B:
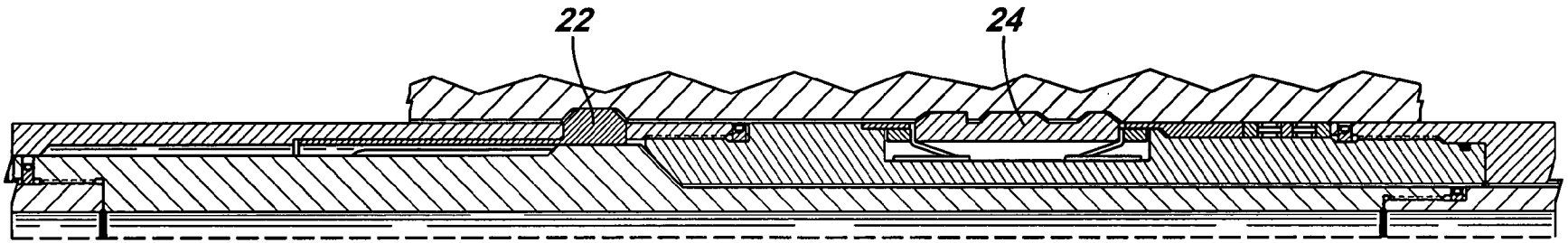
Figure 2C:
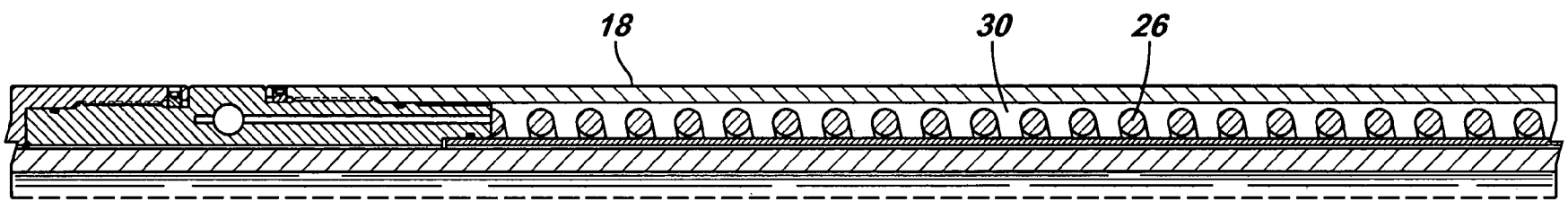
Figure 2D:
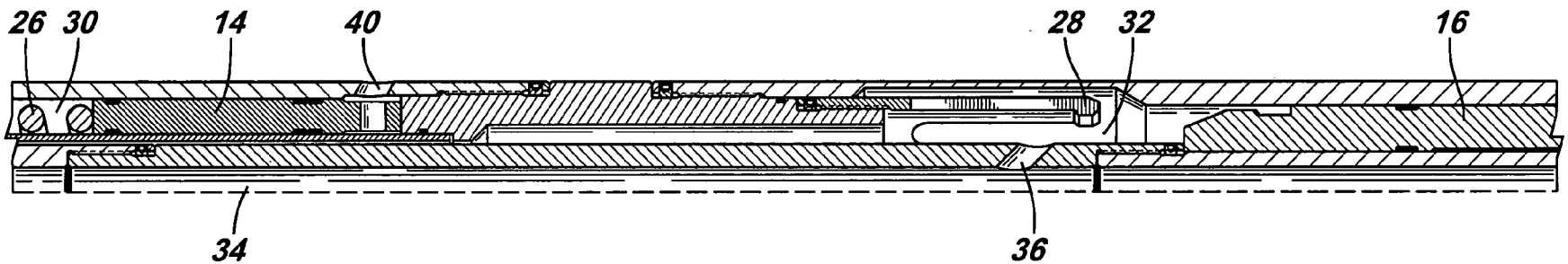
Figure 2E:
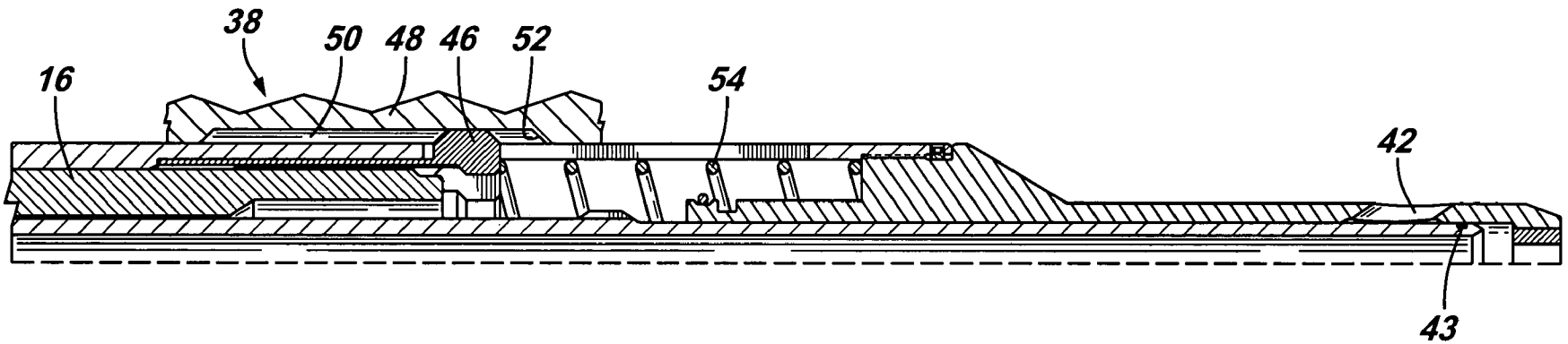

With locator dog 24 properly engaged, inner sleeve 12 is displaced downward (FIGS. 2A–2E) relative to housing 18, disengaging upper collet 20. Inner sleeve 12 is displaced, for example by mechanical means, and moved downward until locking dog 22 is locked in place. That secures shifting tool 10 in place. In this position, shifting element 46 is disposed in recess 50. Also, balance port 42 is sealed closed by seal 43 to prevent fluid communication between interior 34 and the interior of tool body 38.

Figure 3A:
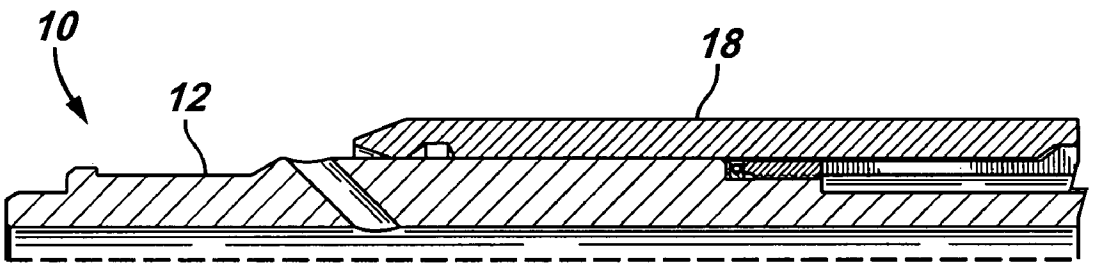
FIGS. 3A–3E are cross-sectional diagrams of the shifting tool of FIGS. 1A–1E, showing the shifting tool in a shifting configuration.
Figure 3B:
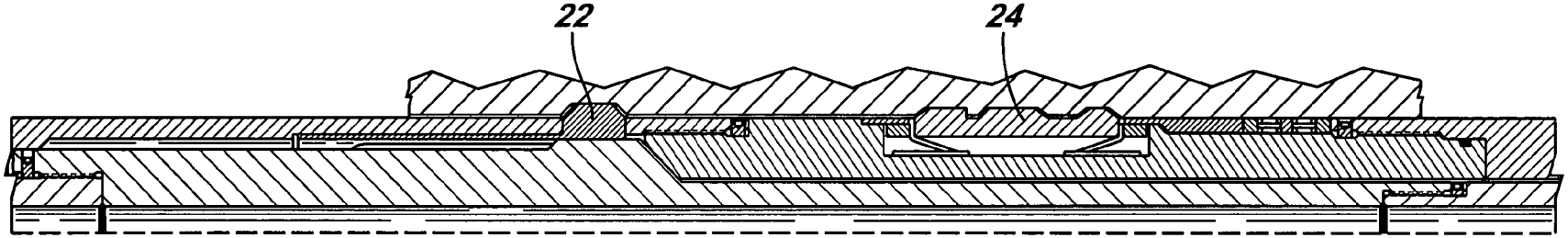
Figure 3C:
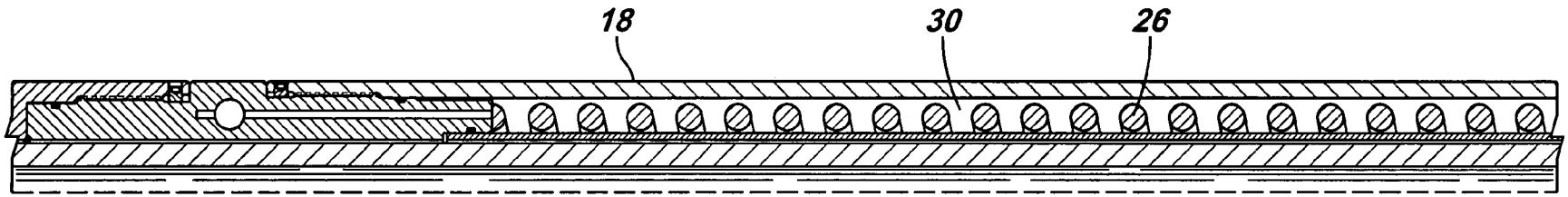
Figure 3D:
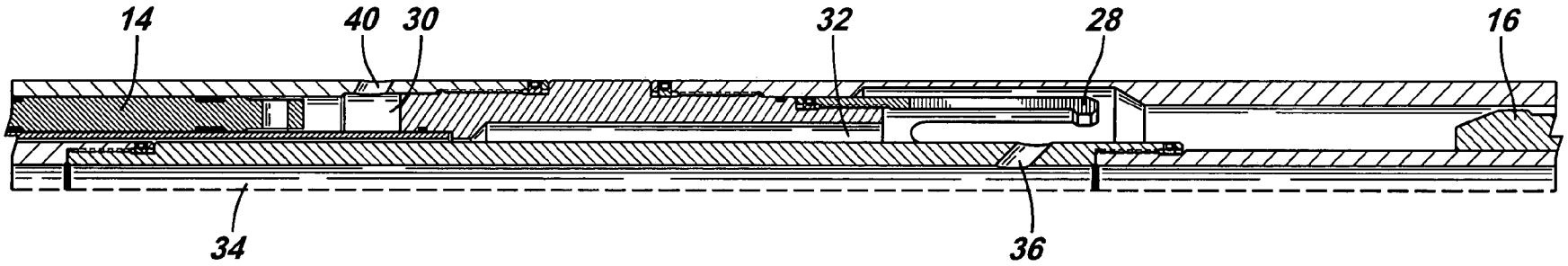
Figure 3E:
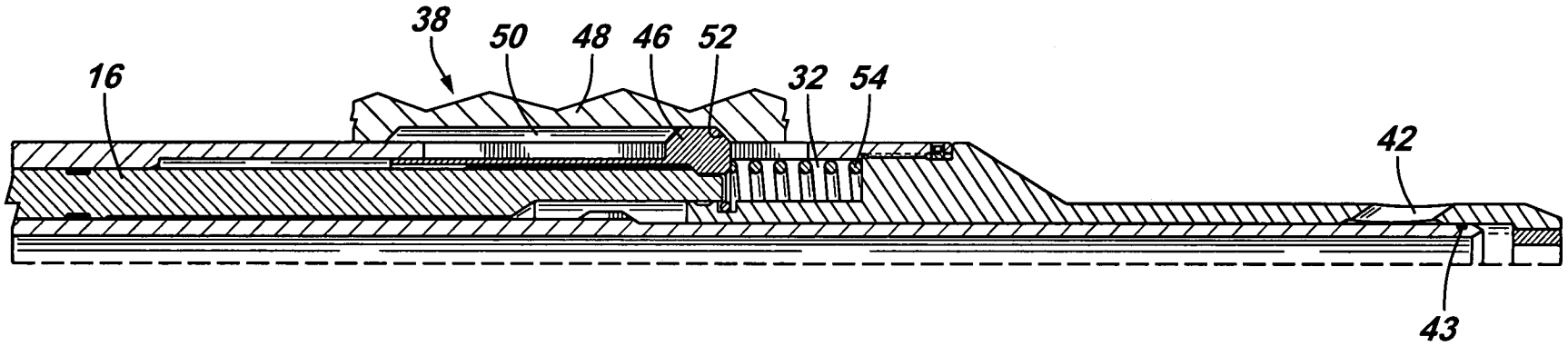

To move moveable assembly 48 (FIGS. 3A–3E), pressure is applied within interior 34. That pressure is communicated to actuator piston 16 via lower port 36 and displaces actuator piston 16 and shifting element 46 downward. Upon sufficient downward movement, shifting element 46 engages and bears on shoulder 52, causing moveable assembly 48 to move downward.

The fluid in chamber 32 is generally incompressible, and must therefore be displaced as actuator 16 moves downward. Because the fluid is in communication with the interior of tool body 38, it can be collected in the lower end of chamber 30 via upper port 40. The fluid pressure acts on compensating piston 14, causing it to be displaced upward, pushing against spring 26. The upper end of chamber 30 may be an atmospheric chamber or may hold compressible fluid such as a charge of gas. Thus, energy may be stored in spring 26 and the compressible fluid, if any, in chamber 30. The upper end of chamber 30 is preferably prepressurized with a compressible fluid to compensate for anticipated hydrostatic pressure within tool body 38.

Compensating piston 14 and the compressible volume in the upper end of chamber 30 allow shifting tool 10 to enter a closed, hydraulically locked volume (i.e., having no hydraulic return path to the surface or into the well annulus). Shifting tool 10 does not merely balance to downhole hydrostatic conditions, but rather carries a displaceable volume into an otherwise hydraulically closed volume. The incompressible fluid in the closed volume must be displaced to allow entry of shifting tool 10 into the closed volume.

Shifting tool 10 routes the incompressible fluid into the lower end of chamber 30, as described above. Compensating piston 14 and chamber 30 also allow work to be done by shifting tool 10, such as moving a piston in the closed volume. Thus, only a single fluid path is required to activate shifting tool 10 remotely. Shifting tool 10 can be placed in a system without using a fluid conduit (e.g., by slickline or wireline) and actuated by pressurizing the system, without providing a separate vent or return path for displaced wellbore fluids. Similarly, shifting tool 10 can be used to remove a tool from a hydraulically locked system.

Figure 4A:
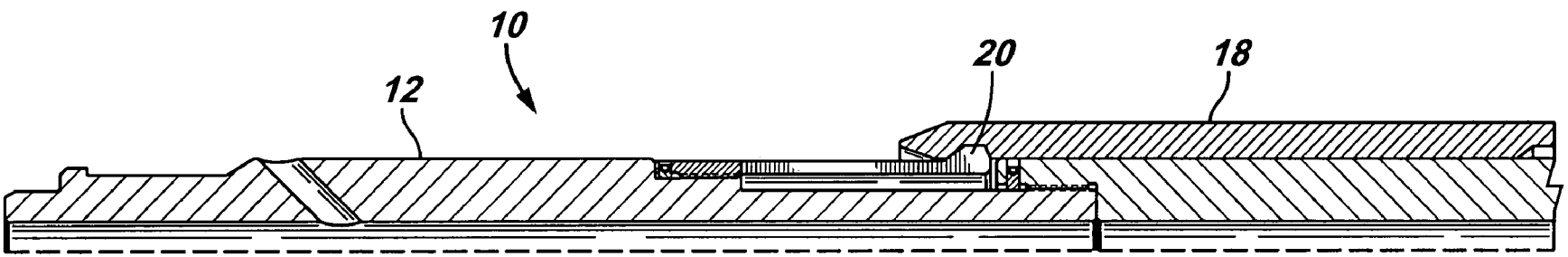
FIGS. 4A–4E are cross-sectional diagrams of the shifting tool of FIGS. 1A–1E, showing the shifting tool in a retrievable configuration.
Figure 4B:
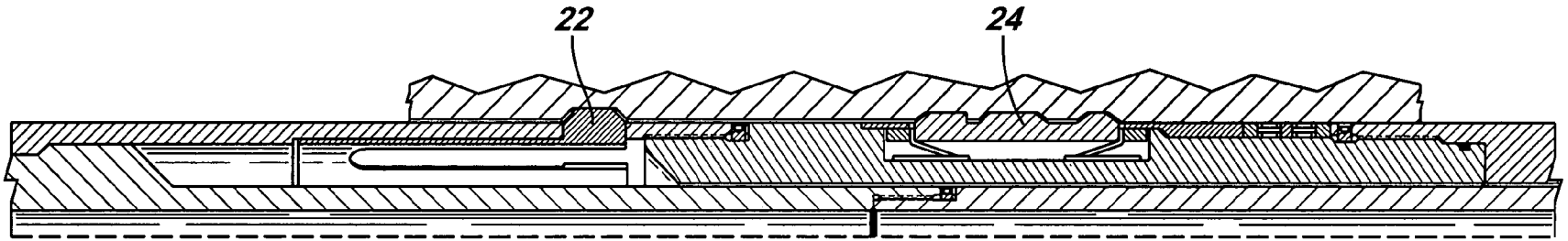
Figure 4C:
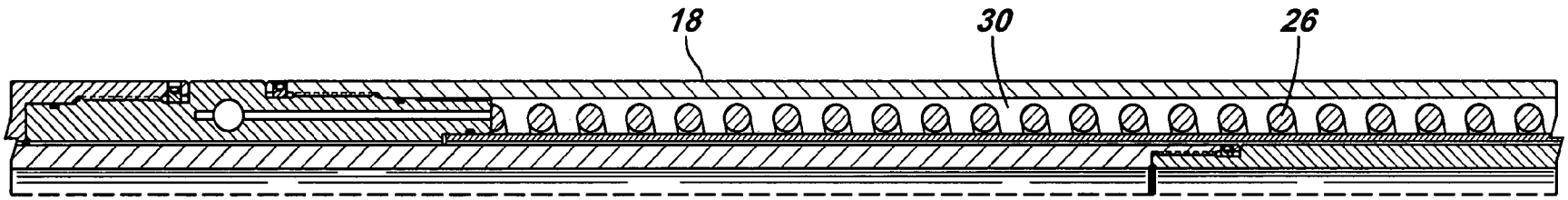
Figure 4D:
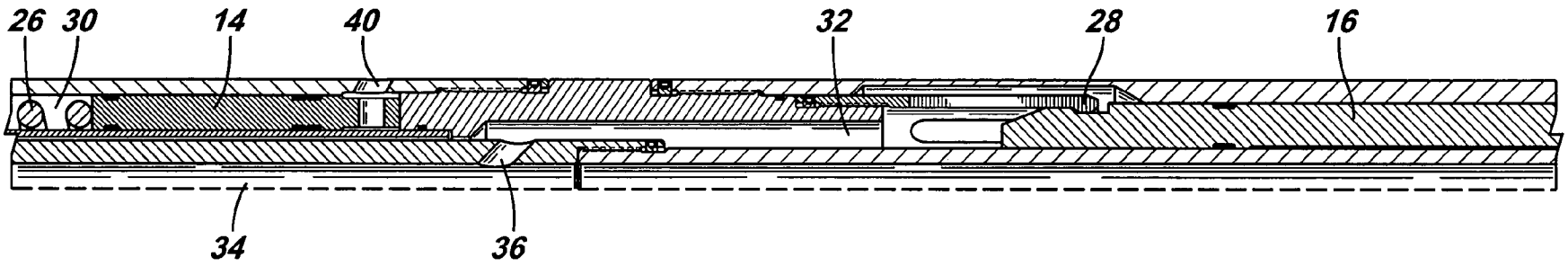
Figure 4E:
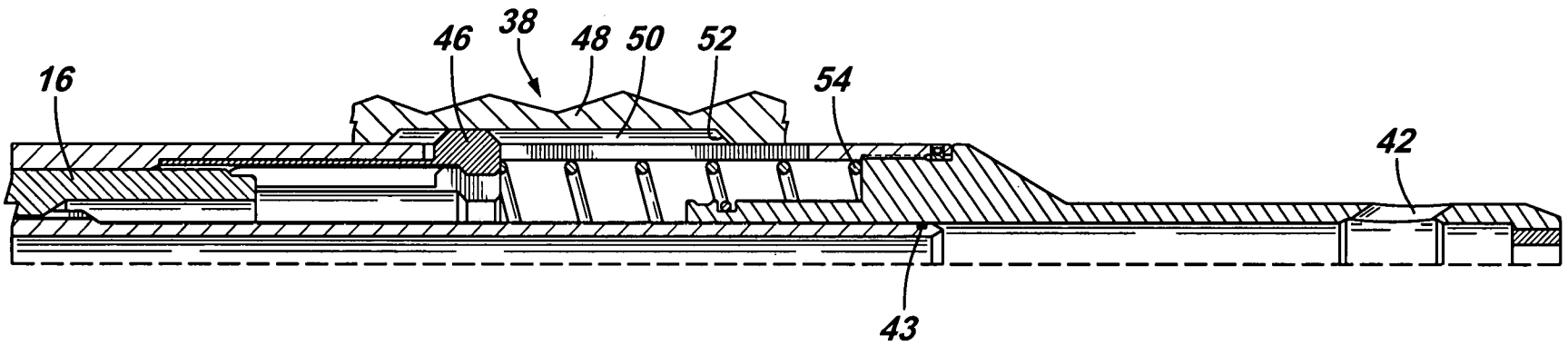

If an operator wishes to repeat the actuation sequence, perhaps because the operator believes a valve failed to open properly, the operator can pull upward on inner sleeve 12. This pulls actuator piston 16 upwards and allows shifting element 46 to move upward in response to lower spring 54 (FIGS. 4A–4E). Inner sleeve 12 is then lowered to again close port 42. Tubing pressure may then be reapplied to repeat the downward displacement cycle. Alternatively, simply bleeding and reapplying the tubing pressure can also repeat this operation. The charged volume in chamber 30 will work to return the piston substantially to its original position. Similarly, if the operator is ready to retrieve shifting tool 10, the operator pulls upward with sufficient force on inner sleeve 12 to release locking dog 22 and locator dog 24. When shifting tool 10 is pulled out of the hole, balancing port 42 is open to allow flow through shifting tool 10. This allows shifting tool 10 to be removed from a hydraulic lock or reduces the effect of an overbalanced (downward flow) well situation. It also eliminates the requirement of equalizing the well before and after operation to allow installation or removal.

In the preceding description, directional terms, such as "upper," "lower," "vertical," "horizontal," etc., may have been used for reasons of convenience to describe the completion valve assembly and its associated components. However, such orientations are not needed to practice the invention, and thus, other orientations are possible in other embodiments of the invention.

Although only a few example embodiments of the present invention are described in detail above, those skilled in the art will readily appreciate that many modifications are possible in the example embodiments without materially departing from the novel teachings and advantages of this invention. Accordingly, all such modifications are intended to be included within the scope of this invention as defined in the following claims. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A shifting tool for use in a subterranean well comprising:

a housing;

a shifting element;

an actuator piston disposed within a first chamber in the housing and adapted to respond to fluid pressure to cause the shifting element to move and engage a profile of another tool that surrounds the housing; and a compensating piston disposed within a second chamber in the housing, the second chamber adapted to receive fluid displaced by movement of the actuator piston to permit the shifting tool to operate in a sealed volume without venting fluid within the sealed volume to the surface or into the well.

2. The shifting tool of claim 1 further comprising locking dogs.

3. The shifting tool of claim 1 further comprising a spring in the second chamber.

4. The shifting tool of claim 1 in which a compressible fluid reside in the second chamber.

5. The shifting tool of claim 1 in which the shifting tool provides a fluid pathway between the first chamber and the second chamber.

6. The shifting tool of claim 1, further comprising:

an inner sleeve having a seal on its lower end to seal a port in the lower end of the housing.

7. The shifting tool of claim 1, wherein the shifting element has a profile to engage a complementary profile in said another tool.

8. The shifting tool of claim 1 further comprising:

an inner sleeve disposed within the housing; and a collet adapted to releasably secure the inner sleeve to the housing.

9. The shifting tool of claim 1 in which the actuator piston is releasably secured to the housing by a collet.

10. The shifting tool of claim 1 in which the shifting tool provides a fluid pathway between the first chamber and a central passageway through the shifting tool.

11. The shifting tool of claim 1, further comprising:

an inner sleeve, wherein the shifting tool can be retrieved by pulling the inner sleeve sufficiently upward.

12. The shifting tool of claim 1 in which the actuator piston can be moved up and down multiple times.

13. The shifting tool of claim 12 in which the actuator piston is cycled by applying and relieving fluid pressure to the actuator piston.

14. The shifting tool of claim 12, further comprising:

an inner sleeve disposed within the housing, wherein the actuator piston is cycled by pulling the inner sleeve upward, then returning the inner sleeve to close a port on the lower end of the housing, and applying pressure to drive the actuator piston downward.

15. The shifting tool of claim 12 further comprising a spring in the first chamber.

16. A shifting tool for use in a subterranean well comprising:

a housing;

an inner sleeve disposed within the housing;

an actuator piston disposed within a first chamber in the housing;

a compensating piston disposed within a second chamber in the housing;

locking dogs that releasably secure the housing to a downhole tool;

locating dogs that releasably engage the downhole tool to properly position the shifting tool;

a spring in the second chamber;

a fluid pathway between the first chamber and the second chamber; and wherein the shifting tool can operate in a sealed volume within the downhole tool without venting fluid within the sealed volume to the surface or into the well.

17. The shifting tool of claim 16 further comprising a compressible fluid in the second chamber.

18. A method to shift a downhole tool element comprising:

running a shifting tool through a tubing to its proper position in the downhole tool;

locking the shifting tool in place;

pressurizing fluid in the tubing to exert a force on and move an actuator piston in the shifting tool;

receiving the fluid displaced by the actuator piston in a chamber within the shifting tool; and moving the tool element in response to the movement of the actuator piston.

19. The method of claim 18 in which the pressurizing, receiving fluid, and moving steps are repeated multiple times.

20. The method of claim 18 further comprising pulling the inner sleeve upward to release the shifting tool for retrieval.

* * * * *